United States Patent [19]

Rütschi et al.

[11] Patent Number: 4,662,475

[45] Date of Patent: May 5, 1987

[54] RAPPELLING ARRANGEMENT

[75] Inventors: Wilhelm Rütschi, Wabern; Gerd-Eberhard Wagner, Hotel Schweizerhof, CH-7514, Sils-Maria, both of Switzerland

[73] Assignee: Gerd-Eberhard Wagner, Sils-Maria, Switzerland

[21] Appl. No.: 707,479

[22] Filed: Mar. 1, 1985

[30] Foreign Application Priority Data

Mar. 2, 1984 [CH] Switzerland ..... 1037/84

[51] Int. Cl.[4] ..... A62B 1/14

[52] U.S. Cl. ..... 182/5; 182/192

[58] Field of Search ..... 182/5–7, 182/236, 237, 231, 234, 75, 239, 71, 72, 190–193; 188/65.1–65.5

[56] References Cited

U.S. PATENT DOCUMENTS

| | | | |
|---|---|---|---|
| 456,532 | 7/1891 | Bliss | 182/192 |
| 2,276,767 | 3/1942 | Dubuque | 188/65.1 |
| 3,739,875 | 6/1973 | Clark-Padwicki | 182/6 |
| 4,097,023 | 6/1978 | Muller | 188/65.1 |
| 4,494,629 | 1/1985 | Raeburn | 182/7 |

FOREIGN PATENT DOCUMENTS

| | | | |
|---|---|---|---|
| 7409766 | 1/1976 | Netherlands | 182/236 |
| 772553 | 10/1980 | U.S.S.R. | 182/5 |

*Primary Examiner*—Reinaldo P. Machado
*Assistant Examiner*—Alvin Chin-Shue
*Attorney, Agent, or Firm*—Brady, O'Boyle & Gates

[57] ABSTRACT

The rope (1) is guided through the nip (24) of a pair of pulleys (6, 7) and is otherwise extended in an S-shape about the pulleys (6, 7) of this pair. Each of these pulleys (6, 7) is connected for rotation with two gear wheels (26, 27) meshing with each other in the zone of the nip (24). Thereby high static friction is ensured between the rope (1) and the pulleys (6, 7), and a slippage of the rope (1) on the pulleys (6, 7), which is life-endangering for the descending person, is reliably prevented. A speed-dependent brake (31) and a brake (33–37) stressed by the weight (G) of the downwardly roping person effect a rate of descent that is extensively independent of this weight.

9 Claims, 2 Drawing Figures

RAPPELLING ARRANGEMENT

Figure 1:
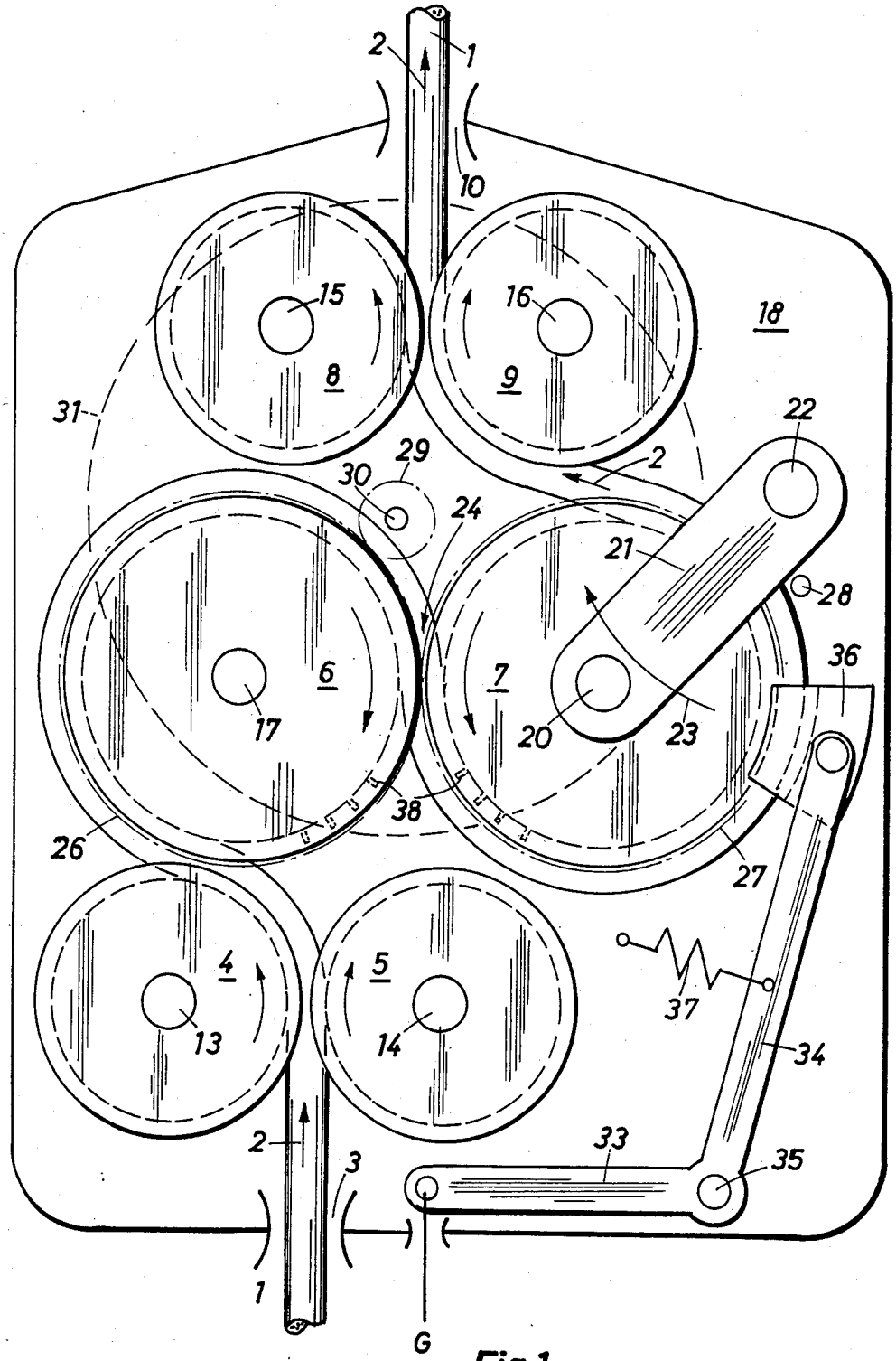

The invention relates to a rappelling arrangement according to the preamble of claim 1.

Rappelling devices of this type have the advantage of an appreciable friction surface between the braked pulleys and the rope guided therearound; the braking force is uniformly distributed over this surface since the pulleys are rotatable only with the safe peripheral speed. This advantage however, comes about only if static friction is ensured between the rope and the pulleys. If the limit of static friction is exceeded, then the rope will slide around the pulleys. Only the very much lower sliding friction is then effective. The brake has no effect. The person hanging on the rope will fall, and can reach almost the rate of free fall inasmuch as the person is merely guided along the rope. The required static friction is quite considerable. For example, with a weight of the person of 70 kg, for a uniform rate of descent of 1–4 m/s, a power of about 0.7–2.5 kW must be dissipated by braking, and for this purpose must be transmitted by static friction, i.e. in a force-locking fashion, from the rope to the braked pulleys.

In a conventional rappelling arrangement of this type (Swiss Pat. No. 494,704), the two pulleys are rotatably mounted respectively about a fixed axle at a mutual spacing, and the rope runs linearly freely from one pulley to the other. A brake to be operated manually acts on one of the pulleys. To attain static friction, the rope is urged against the other pulley by a freely rotatable, displaceably mounted, spring-loaded guide and pressure roller. Since the roller is freely rotatable, only the surface portion of the rope pressed against this pulley is effective, besides the contact force of the roller, for the static friction obtained by the roller; this portion extends over less than half the circumference of the rope cross section along the clamped-in-place rope section which is relatively short due to the small roller diameter. The tension of the rope traveling on the guide and pressure roller during roping down acts against the spring force and thus against the contact force of the roller. This can become dangerous for the rappelling person if an assisting person exerts tension on the lower rope end to prevent pendulating of the descending person, or if such assisting person holds the rope obliquely under tension so that the roping down path leads obliquely away from a burning building. The brake, to be operated manually, does make it possible for the descending person to adapt the braking force to his or her body weight. However, the risk of erroneous operations that could have life-endangering consequences is considerable, particularly in the panic situation when roping down off a burning building, the more so because the rappelling person usually has no experience whatever in operating the brake and will become even more panicky in case of an unexpected braking characteristic.

The roping-down devices of this type are to be distinguished from those wherein the rope is wound onto a braked drum arranged in the device, and runs off this drum during down roping. In this case, the problem of a reliable static friction between rope and elements of the device does not exist, yet other disadvantages occur instead. Thus, the rope must be wound onto the drum tightly and exactly layer upon layer. Otherwise, sudden, jerky accelerations are unavoidable during rappelling; these accelerations are not without danger. The rope drum with the rope is relatively large and heavy for great rappelling heights. If a person intends to rappel, for example, out of a window in case of danger of fire, a relatively large, relatively heavy rappelling system is not only cumbersome, but even dangerous. Also, as compared with such rappelling arrangements, those of the type discussed in the beginning exhibit the advantage that a pendulating of the rappelling person can be prevented in that an assisting person retains the lower end of the rope, and in that rappelling can be performed also on an incline and thus, in the medium and lower portions of the path of descent, at a spacing, for example, from a burning building, by means of an assisting person who holds the lower end of the rope at a distance from the building.

The invention is based on the object of providing a rappelling arrangement preventing, by simple, reliable means, a no longer controllable sliding of the pulleys along the rope that would endanger the person descending, even if an assisting person keeps the rope taut by seizing the lower end of the rope, and wherein the rate of descent during rappelling is practically independent of the weight of the descending person without any manual regulation being required.

This object has been attained, in a rappelling arrangement of the type discussed above, by the invention as characterized in claim 1. Advantageous further developments of this invention are the subjects of claims 2–10.

The advantages attained by the invention are to be seen essentially in that, in the nip, mutually opposed faces of the clamped-in-place rope portion are respectively in contact with one of the braked pulleys, and that the clamped-in rope portion, on account of the large pulley diameter, is longer than on a guide and pressure roller, and that it is possible by means of the brake stressed by the weight of the rappelling person to ensure a substantially optimum rate of descent so that lightweight persons, for example also children, will not drop too gradually, and heavy persons will not drop exceedingly rapidly. If the brake is designed to be manually controllable, then this control can be restricted to a range of no consequence for all weights of persons to be considered. The embodiment of the rappelling arrangement indicated in claim 6 is especially advantageous, wherein the clamping force in the nip is larger in case of a heavier person descending than in case of a more lightweight one. Advantages of additional embodiments can be derived from the description of the practical examples of the invention.

Two embodiments of the invention are illustrated in the appended schematic drawings and will be described in greater detail below with reference to modifications.

Figure 2:
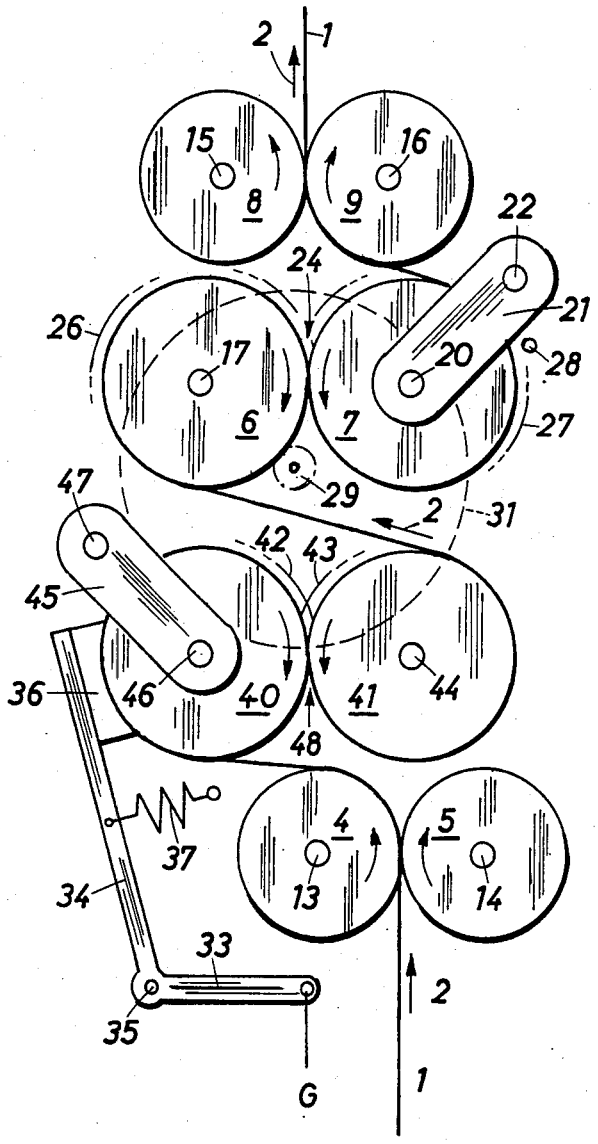

FIGS. 1 and 2 show the arrangement of the pulleys, guide rollers and brakes of the first and second embodiments, respectively, the representation in FIG. 2 being simplified.

In FIG. 1, the rope 1, which travels through the rappelling arrangement during descent in the direction of the arrows 2 indicated on the rope, is guided from an inlet opening 3 of the housing of the arrangement, which housing is otherwise not illustrated, through a pair of guide rollers 4 and 5, from these in an S-shape about the pulleys 6 and 7 of a pair of pulleys, and from there through a second pair of guide rollers 8 and 9 to an outlet opening 10 of the housing. The upper end of the rope is attached at the rappelling point, for performing rescue in case of fire, for example, at a window aperture or at a balcony. The pair of guide rollers 4 and 5 is arranged with respect to the pulley 6, and the pair of guide rollers 8 and 9 is arranged with respect to the pulley 7 in such a manner that the rope 1 loops around each of the pulleys 6 and 7 along an arc of almost 270°. The guide rollers 4, 5, 8 and 9 and the pulley 6 are disposed rotatably on axle journals 13–17 which latter are mounted on a supporting plate 18. The pulley 7 is rotatably supported on an axle journal 20 at the free end of a rocking lever 21, the latter being swingable about a pin 22 attached to the supporting plate 18 and being arranged obliquely to the connecting line of the axle journals 17 and 20, as well as transversely to the direction in which the rope 1 runs off from the pulley 7. This has the result that the tension of the rope 1, produced by the device with the rappelling person dropping on the rope 1 in a braked fashion, exerts a torque (arrow 23) on the rocking lever 21; this torque urges the pulley 7 in the direction toward the pulley 6 whereby a nip 24 is produced between the pulleys 6 and 7 wherein the rope 1 is clamped the more tightly, the greater the weight G of the person suspended on the arrangement. The brake 33–37 described further below, stressed by the weight of the rappelling person, acts also along these lines.

Each of the pulleys 6 and 7 is connected for rotation with one of two gear wheels 26 and 27, of which FIG. 1 shows only the pitch circles (in FIG. 2 the crown lines are shown). The gear wheels 26 and 27 mesh at the location which has the same spacings from the pulley journals and gear wheel journals 17 and 20, respectively, as the nip 24. As a result, the pulleys 6 and 7 can revolve perforce only together, with oppositely identical peripheral speeds. If, as in FIG. 1, the pulleys 6 and 7 have the same diameter, the gear wheels mesh in the center between the axle journals 17 and 20.

Although, in the examples, the rope pulleys 6 and 7 have identical diameters, it can be advantageous to choose for the pulley 7 a maximally large diameter, in which case the pulley 6 then will be provided with a smaller diameter for reasons of space. This is done because this pulley 7 is the location where the tensile force on the rope, and thus also the force with which the rope is pressed against this pulley in the looping-around zone, is the largest so that it can be advantageous to guide the rope on this pulley along a maximally large arc, i.e. to select not only the looping angle to be as large as possible, namely almost 270°, but also the pulley diameter to be maximally large.

A stop 28 limits the movement of the rocking lever 21 in the position wherein the teeth of the gear wheels 26 and 27 are still in reliable meshing engagement.

A pinion 29 meshes with the gear wheel 26; this pinion is seated on the shaft 30 of the rotor (not shown) of a brake 31, responsive to the number of revolutions, mounted to the rear side of the supporting plate 18. This brake is, for example, a centrifugal brake, but it can also be a hydraulic brake.

A two-armed angle lever 33, 34 is supported to be rotatable about a pin 35 attached to the supporting plate 18. A seating harness or the like is suspended, for the rappelling person, for example on one lever arm 33 so that the weight G of the person acts on this lever arm 33, and the brake shoe 36, articulated to the other lever arm 34, presses the more tightly against the circumferential rim of the flanges of the pulley 7, the greater the weight G. This results not only in a braking action in dependence on the weight, but the rope 1 is also clamped in the nip 24 the more tightly, the greater the weight G. The brake 33–36 is prestressed by a tension spring 37 resting on the bearing plate 18. On account of the fact that the pulleys 6 and 7 can revolve positively only together, due to the gear wheels 26 and 27, the speed-dependent brake 31 as well as the friction brake 33–37 act to an equal extent on both pulleys 6 and 7. The point where the force G is effective on the lever arm 33 lies in alignment with the direction wherein the rope 1 exits from the arrangement through the outlet opening 10, so that the arrangement, in use, is suspended on the rope 1 in a straight orientation.

The pulleys 6 and 7, braked in unison, are equipped with a friction coating (not shown) that is suitably scored transversely. In place thereof, or in addition, the pulleys 6 and 7 can be provided with radial pegs 38, of which only a few are illustrated; these pegs engage into the rope 1 or into a suitable sheath of the rope 1 and retain the latter on the pulleys in an especially nonslip fashion. The guide roller 4 is located in such close proximity to the pulley 6 that the pegs 38 are reliably pressed into the rope 1 or into its sheathing, as soon as the rope enters the pulley 6.

In the second embodiment according to FIG. 2, the components corresponding to the first embodiment are denoted with the same reference numerals as in FIG. 1. The description in connection with FIG. 1 applies analogously to these components. Additionally to FIG. 1, a second pair of pulleys 40, 41 is provided in FIG. 2, around which the rope 1 is likewise guided in an S-shaped fashion. Also these pulleys 40, 41 are connected for rotation with meshing gear wheels indicated at 42, 43 so that the pulleys are rotatable only together with oppositely identical peripheral speeds, but independently of the pair of pulleys 6, 7. The latter aspect is importance so that the rope is constantly tensioned, from the point where it enters the pulley 40 up to the point where it leaves the pulley 7, especially so that it also runs onto the pulley 6 in the tensioned condition. The pulley 41, corresponding to the pulley 6, is rotatably mounted on an axle journal 44 fixedly arranged in the housing, and the pulley 40, in correspondence with the pulley 7, is rotatably arranged on an axle journal 46 attached to the free end of a rocking lever 45. The rocking lever 45 is rotatably mounted, analogously to the rocking lever 21, about a journal 47 fixedly disposed in the housing. The load-dependent, pretensioned brake 33–37 urges the pulley 40 in the direction toward the pulley 41 so that both pulleys are braked the more vigorously, and the rope 1 is clamped in the nip 48 between the pulleys 40 and 41 the more tightly, the greater the weight G. As compared with the first embodiment, this second embodiment has the advantage, inter alia, that the rope 1 is tensioned when it enters the pulley 6. In this arrangement, without pegs 38 (FIG. 1), a reliably adequate static friction of the rope 1 in the system can be achieved whereas, in the first embodiment, depending on the coefficient of friction of the rope material with respect to the pulleys 6 and 7 or their friction coating, and the diameter of these pulleys, pegs 38 to avoid slippage between the rope 1 and the pulleys 6 and 7 can be necessary or expedient for safety's sake.

We claim:

1. A rappelling arrangement comprising, a rope (1), a device adapted to carry a person for effecting a controlled descent along said rope (1), said device including a pair of rotatable pulleys (6,7;40,41) defining a nip (24;48), through which said rope (1) passes during the rappelling operation, one (7;40) of said pulleys of said pair of pulleys (6,7;40,41) being movably mounted on a rocker arm (21;45) pivoted to said device to move in a direction toward and away from the other pulley (6;41) of said pair of pulleys (6,7;40,41), means spring-loading (37) said one pulley (7;40) so that said one pulley (7;40) is urged by the spring force (37) in the direction toward said other Pulley (6;41) and the rope (1) is permanently clamped in said nip (24;48) between said pulleys of said pair of pulleys (6,7;40,41), said other pulley (6;41) of said pair of pulleys (6,7;40,41) being non-displaceably mounted on said device, said rope (1) being looped around at least one of said pulleys of said pair of pulleys (6,7;40, 41) such that during the rappelling operation the rope (1) after having apssed said nip (24;48) immediately runs about one of said pulleys of said pair of pulleys (6,7;40,41), at least one brake (33–37,31) to brake at least that pulley (7;41) of said pair of pulleys (6,7;40,41), about which (7;41) the rope (1) runs during the rappelling operation immediately after having passed said nip (24;28).

2. A rappelling arrangement comprising, a rope (1), a device adapted to carry a person for effecting a controlled descent along said rope (1), said device including a pair of rotatable pulleys (6,7;40,41) defining a nip (24;48) through which said rope (1) passes during the rappelling operation, one (7;40) of said pulleys of said pair of pulleys (6,7;40,41) being movably mounted to move in a direction toward and away from the other pulley (6;41) of said pair of pulleys (6,7;40,41), which other pulley (6;41) is non-displaceably mounted on said device, a brake (33–37) acting on said one pulley (7;40) being movably mounted in such a way that said one pulley (7;40) is urged by the brake force in the direction toward the other, non-displaceable pulley (6;41) of said pair of pulleys (6,7;40,41) and the rope (1) is clamped in said nip (24;48) between the pulleys of said pair of pulleys (6,7;40,41) with a pressure proportional to the brake force, a spring (37) connected to operate said brake (33–37), means for securing a carrier for the descending person, an element (33) connected to operate said brake (33–37) having said means for securing a carrier for the descending person connected thereto, the force of the spring (37) and the weight (G) of the descending person operative to stress the brake (33–37) in the same direction, so that the brake force is the sum of a spring force component and a weight component proportional to the weight (G) of the descending person, said rope (1) being looped around at least one (7;41) of said pulleys of said pair of pulleys (6,7;40,41) such that during the rappelling operation the rope (1) after having passed said nip (24;28) immediately runs about the one (7;41) of said pulleys of said pair of pulleys (6,7;40,41), which one (7;41) of said pulleys is either the pulley (7), on which said brake (33–37) acts or is coupled (42,43) with the pulley (40) on which said brake (33–37) acts so that it is rotatable only with mutually opposite and identical peripheral speed.

3. Rappelling arrangement according to claim 2, in which the brake (33–37) operated by said spring (37) and said element (33) includes a brake shoe (36) attachcd to an arm (34) of a two-armed lever (33,34) swingably supported (35) in the lower part of said device, the other arm (33) comprising said element (33) and being provided with said means for securing a carrier for the descending person.

4. Rappelling arrangement according to claim 2, characterized in that the pulleys (6,7;40,41) exhibit a preferably transversely scored friction coating (38) penetrating into the rope (1).

5. A rappelling arrangement as set forth in claim 2, including a gear transmission (26,27;42,43) having teeth or other positive cooperating elements connected to couple said pair of pulleys (6,7;40,41) so that they are rotatable only with mutually opposite and identical peripheral speeds, said rope (1) being looped around said pair of pulleys such that is extends in an S-shape about the pair of pulleys (6,7;40,41) and, in the turning point of the S-shape, is guided through said nip (24;48) formed between said pair of pulleys (6,7;40,41), a rocking arm (21;45) on said device, and said one (7;40) of said pulleys of said pair of pulleys (6,7;40,41), on which said brake (33–37) acts, rotatably mounted on said rocking arm (21;45) so that said one pulley (7;40) is urged by the tensile force (2) of the rope (1) guided around it (7;40) in the direction toward the other pulley (6;41) of said pair of pulleys.

6. Rappelling arrangement according to claim 5, characterized in that the movement of the rocking arm (21;45) in opposition to the torque (23) exerted on said rocking arm by the force exerted by the brake on said one pulley (7;40) of said pair of pulleys, is restricted by a stop (28).

7. Rappelling arrangement according to claim 5, in which, in addition to said pair of pulleys (40,41), two pulleys (6,7) are provided, forming a second pulley pair, a second gear transmission (26,27) having teeth or other positive cooperating elements connected to couple said second pulley pair (6,7) so that they are rotatably only with mutually opposite and identical peripheral speeds; said rope (1) being looped around said second pulley pair such that is extends in an S-shape about the two pulleys (6,7) of the second pulley pair and, in the turning point of the S-shape, is guided through a second nip (24) formed between said two pulleys (6,7) of said second pulley pair, and passing first around the first mentioned pair of pulleys said second pulley pair during the rappelling operation (FIG. 2).

8. Rappelling arrangement according to claim 1 or 2, characterized in that the rope (1) loops about each of the pulleys (6,7,40,41) along an arc of approximately 270°.

9. Rappelling arrangement according to claim 5 or 7, in which each pulley of the, or respectively of each, pulley pair (6,7;40,41) is connected for rotation about an axle (17,20;44,46), and said gear transmission comprises a pair of gear wheels (26,26;42,43) which latter mesh with each other at a location having the same spacings from the pulley axles (17,20;44,46) as the nip (24;48).

* * * * *